US006456007B1

(12) United States Patent
Ryu et al.

(10) Patent No.: US 6,456,007 B1
(45) Date of Patent: Sep. 24, 2002

(54) BARRIER STRUCTURE FOR PLASMA DISPLAY PANEL AND FABRICATION METHOD THEREOF

(75) Inventors: Byung-Gil Ryu, Seoul; Jae-Sang Chung, Seongnam; Eun-Ho Yoo, Koyang; Seok-Kon See, Seongnam-Do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/394,431

(22) Filed: Sep. 13, 1999

(30) Foreign Application Priority Data

Sep. 14, 1998 (KR) ..... 98/37849

(51) Int. Cl.[7] ..... H01J 9/24
(52) U.S. Cl. ..... 313/586; 445/24; 313/582
(58) Field of Search ..... 445/24; 313/582, 313/584, 587

(56) References Cited

U.S. PATENT DOCUMENTS 5,701,056 A * 12/1997 Shinohara ..... 313/584
5,705,886 A * 1/1998 Bongaerts et al. ..... 313/584
5,757,131 A * 5/1998 Tsuchiya ..... 313/582
5,982,095 A * 11/1999 Jin et al. ..... 313/582
5,982,096 A * 11/1999 Baller ..... 313/585

* cited by examiner

*Primary Examiner*—Kenneth J. Ramsey
(74) *Attorney, Agent, or Firm*—Fleshner & Kim, LLP

(57) ABSTRACT

The present invention relates to a barrier structure for a PDP and a fabrication method thereof which are capable of enhancing a discharge efficiency by increasing a discharge space. The barrier structure according to the present invention includes a first barrier layer formed of an insulation substrate having a groove and plane portion formed thereon, and a rib-shaped second barrier layer formed on the plane area of the first barrier layer with respect to the groove. In the present invention, it is possible to increase the plasma discharge efficiency by increasing the coated area of the fluorescent material in the plasma discharge space and it is easy to fabricate the barriers having uniform heights for thereby enhancing a reliability of the PDP. In addition, it is possible to prevent an increase of the discharge voltage by adapting the barrier structure according to the present invention to the opposite electrode type PDP for thereby enhancing an efficiency of the PDP.

28 Claims, 7 Drawing Sheets

BARRIER STRUCTURE FOR PLASMA DISPLAY PANEL AND FABRICATION METHOD THEREOF

BACKGROUND OF THE INVENTION

1. Field of the Invention

The present invention relates to a flat panel display apparatus, and in particular to a barrier structure for a PDP(Plasma Display Panel) and a fabrication method thereof which are capable of increasing a discharge efficiency by obtaining a larger discharge space.

2. Description of the Background Art

Recently, a flat panel display apparatus such as a LCD (Liquid Crystal Display), a FED(Field Emission Display), a PDP(Plasma Display Panel), etc. is widely used. Among these flat panel display apparatuses, the PDP is most widely used and has good characteristics of an easier fabrication, a high luminance and high light emitting efficiency, a good memory function, and a wider field-of-view, so that the PDP is well adapted to a large size screen.

The structure of a conventional surface discharge AC PDP will be explained with reference to FIG. 1.

First, a certain space is formed between a front glass substrate 10 and a rear glass substrate 20, and a discharge space 30 defined by a barrier 23 is formed between the front glass substrate 10 and the rear glass substrate 30.

A plurality of parallel address electrodes A are formed on the upper surface of the rear glass substrate 20, and a dielectric layer 22 is formed on the upper surface of the rear glass substrate 20 and the upper surface of the address electrodes A.

A plurality of barriers 23 are formed on the upper surface of the dielectric layer 22 between the address electrodes A. A fluorescent layer 24 is formed on the upper surface of the dielectric layer 22 which covers both side barrier surfaces of the barriers 23 and the address electrodes A. A sustain/scan electrode Xn and a sustain electrode Yn are spaced-apart on one surface of the front glass substrate 10 in the direction perpendicular to the direction of the address electrode A. The sustain/scan electrode Xn and the sustain electrode Yn are generally formed of an ITO(Indium TiN Oxide) which is transparent so that light easily passes therethrough. Bus electrodes 13 are formed at the end portions of the sustain/scan electrode Xn and the sustain electrode Yn for applying a stable driving voltage. The bus electrode 13 is formed of an aluminum or chrome/copper/chrome layer. In addition, a PbO group dielectric layer 14 covers on the sustain/scan electrode Xn, the sustain electrode Yn, the bus electrode 13 and the front glass substrate 10, and a MgO film is coated on the bus electrode 13 and the front glass substrate 10 and acts as a protection film 15. The above-described MgO protection film protects the PbO dielectric layer from a sputtering operation of ions and provides a characteristic of a relatively high secondary electron generation coefficient when a low ion energy collides with the surface during the PDP discharge for thereby decreasing a driving and sustaining voltage of the discharge plasma.

He, Ne, Ar or a combined gas of the same and a combined gas 31 of Xe are sealingly filled in a discharge cell in the interior of the PDP of FIG. 1 surrounded by the barriers.

The space between the barriers is a discharge space 30 in which a discharge is performed.

FIG. 2 is a cross-sectional view taken along II—II of FIG. 1. Since the same reference numerals in FIGS. 1 and 2 indicates the same elements, the description on the construction of FIG. 2 will be omitted.

The operation principle of the conventional PDP is as follows. Namely, when a certain driving voltage is applied between the address electrode A and sustain/scan electrode Xn, a certain cell which is located where the electrodes are crossed is selected and then a wall discharge occurs on the surface of the dielectric layer thereof. After that discharge, when a certain driving voltage is applied to the sustain electrode and sustain/scan electrode, a plasma discharge occurs on the surface of the dielectric layer, and an infrared ray generated based on the plasma discharge excites fluorescent materials of Red(R), Green(G), and Blue(B), and a visual ray of the R, G and B generated at the fluorescent materials is incident into the glass substrate via the dielectric layer and the display electrode for thereby displaying a certain character or graphic.

FIG. 3 illustrates a discharge space 30 in which a plasma discharge occurs at the PDP of FIGS. 1 and 2. As shown therein, a dielectric later 22 is formed on the rear glass substrate 20, and a barrier 23 is formed on the dielectric layer 22 for separating each discharge cell. The size of the discharge space 30 is determined based on the height of the barrier 23 and a distance between the barriers 23. In the conventional PDP, the height of the barrier is about 150 $\mu$m, and the width(a distance between the barriers, namely, the size of the bottom in the discharge space) is about 300 $\mu$m. In addition, a fluorescent layer 24 having a thickness of about 20 $\mu$m is formed on the wall of the barrier 23 and the upper surface of the dielectric material 22. Therefore, the area of the fluorescent layer is determined based on the size of the discharge space.

In the conventional PDP having a certain size of the discharge space as shown in FIG. 3, the discharge efficiency is about 11 m/w which is relatively low compared to the light emitting efficiency(51 m/w) of the Braun Tube.

Therefore, it is very important to improve the light emitting efficiency in the field of the PDP.

Here, the light emitting efficiency is obtained based on the following Equation 1.

$$F = K\eta_{q}h_{\nu}\gamma\Phi \qquad \text{Equation 1}$$

where F represents a light speed of output visual light, K represent an area of the surface of the fluorescent material in the discharge space, _represents a discharge cell escape efficiency of the visual light from the fluorescent material, $\eta_q$ represents an quantum efficiency of the fluorescent material $h_\nu$ represents an energy of the visual light, $\gamma$ represents a sensitivity(1 m/W), and $\Phi$ represents a speed of the visual light which reach at the unit surface of the discharge cell. Therefore, as seen in Equation 1, the discharge efficiency is determined based on the area of the fluorescent material and the amount of the infrared ray. The area of the fluorescent material may be increased by increasing the discharge efficiency.

The area of the fluorescent material may be increased by increasing the size of the discharge space, but in order to increase the discharge space in the limited panel space, the width of the barrier and the height of the barrier should be increased. However, according to the conventional barrier fabrication method such as a sand blast method, a screen printing method, an etching method, etc., it is impossible to uniformly form the barriers having a certain height above 150 m. Therefore, in order to enhance the discharge efficiency, a method for maintaining the height of the barrier at 150 m and increasing the discharge space is required.

SUMMARY OF THE INVENTION

Accordingly, it is an object of the present invention to provide a barrier structure and a fabrication method which are capable of enhancing an efficiency of a PDP.

It is another object of the present invention to provide a PDP barrier structure and a fabrication method thereof which are capable of increasing a discharge efficiency by forming a second a second barrier on the upper surface of a first barrier and increasing the surface area of the fluorescent materials.

In the PDP barrier structure according to the present invention, a two-tire structure formed of a first barrier layer formed on a substrate and having a certain height and a second barrier layer formed on the first barrier is disclosed.

To achieve the above-objects, there is provided a fabrication method for a barrier structure of a PDP according to the present invention which includes the steps of forming an insulation layer having a certain thickness on a substrate, forming a photoresist film pattern on the insulation layer, forming a first barrier layer by etching the insulation layer using the photoresist film pattern as a mask and forming a groove on the insulation layer, removing the photoresist film pattern, and forming a second barrier layer on the first barrier layer at the portion in which the photoresist film pattern is removed.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The barrier structure for a PDP(Plasma Display Panel) according to the present invention will be explained.

Figure 4:
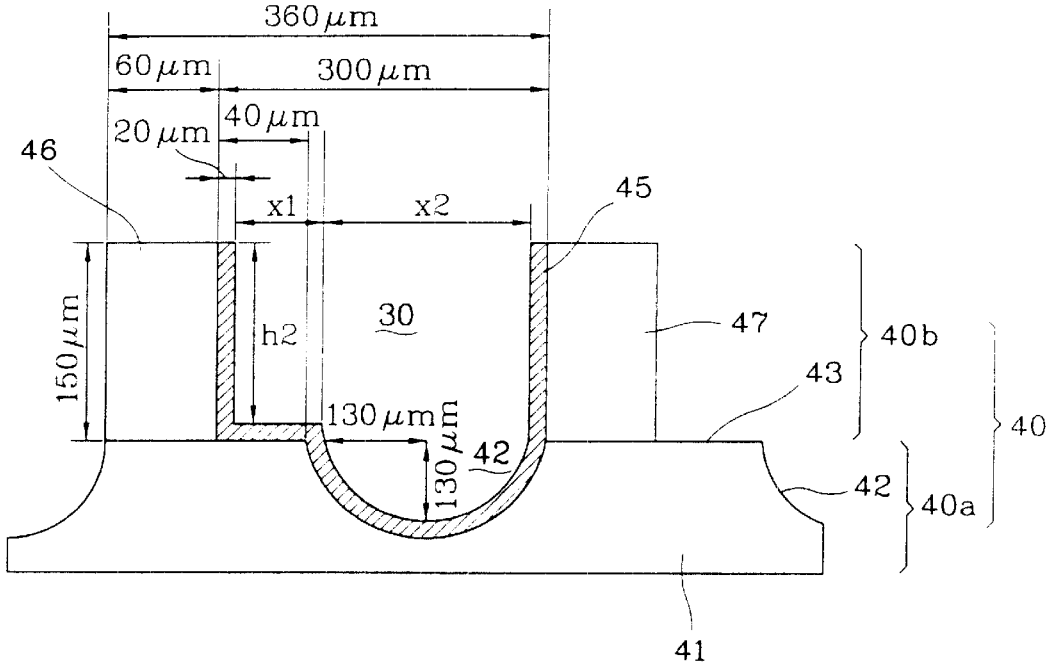
FIG. 4 is a cross-sectional view illustrating a barrier of a PDP according to the present invention.

FIG. 4 illustrates the structure of a barrier. The description on the elements except for major elements which form the PDP will be omitted.

First, a barrier 40 according to the present invention is formed of a first barrier 40*a* and a second barrier 40*b*.

The first barrier 40*a* and the second barrier 40*b* are made of a certain insulation material having a high reflection ratio, for example, glass.

The first barrier 40*a* has a thickness of about 200 μm, and a semi-circular groove 42 having a radius of about 130 μm is formed on a certain upper portion of the first barrier 40*a*. The upper surface of the insulation substrate 41 except for the groove 42 is called as a plane area 43.

A rib-shaped second barrier layer 40*b* is formed on a certain portion of the plane area 43 of the first barrier layer 40*a*. At this time, a rib portion 46 of the second barrier layer 40*b* is spaced apart from the edge portion of the groove 42 at a certain distance(for example, about 40 μm) and is formed on the plane area 43, and a rib portion 47 of the same is arranged at the end portion of the groove 42 and is formed on the plane area 43.

In the barrier structure according to the present invention, a discharge space 30 is formed by the groove 42 and the rib portions 46 and 47.

A fluorescent layer 45 having a thickness of about 20 μm is coated on the surfaces of the first barrier layer 40*a* and the second barrier layer 40*b* of the discharge space 30.

In the PDP having a barrier structure according to the present invention, the surface area of the discharge space is increased, and the coated area of the fluorescent is increased, so that the discharge efficiency is significantly increased.

The coated areas of the fluorescent material of the discharge space of the PDP having the barrier structure(FIG. 3) in the conventional art and the barrier structure(FIG. 4) according to the present invention may be compared for the above-described effects.

Figure 3:
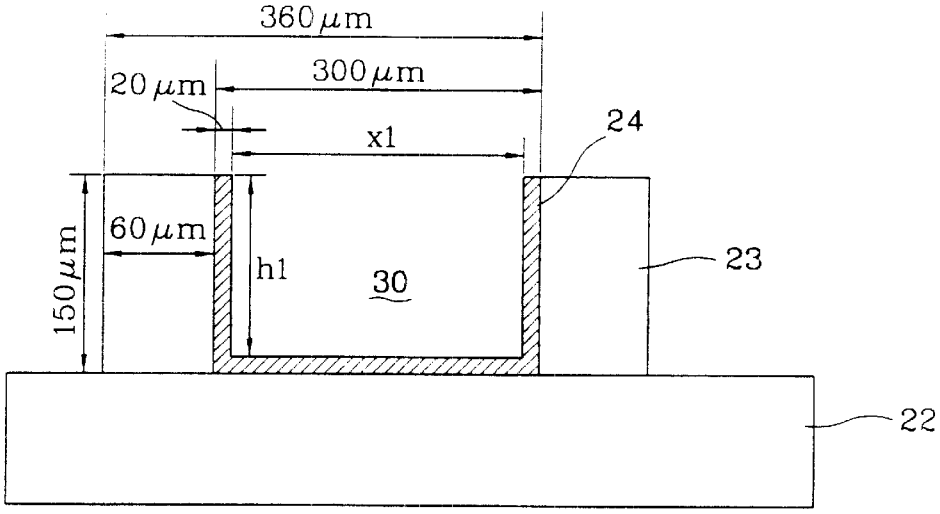
FIG. 3 is a view illustrating schematic view illustrating a barrier structure which defines a discharge space of FIG. 2.

Before the coated areas of the fluorescent materials are compared, it is assumed that the heights of the barriers of FIGS. 3 and 4(in the present invention, the height of the second barrier layer) are same. In addition, in order to compare the surface areas of the fluorescent materials, the width of the barrier should be known. But, since it is assumed that the widths of the barrier of FIG. 3 and the barrier of the second barrier layer are same, only the entire lengths of the fluorescent layers are compared.

Figure 1:
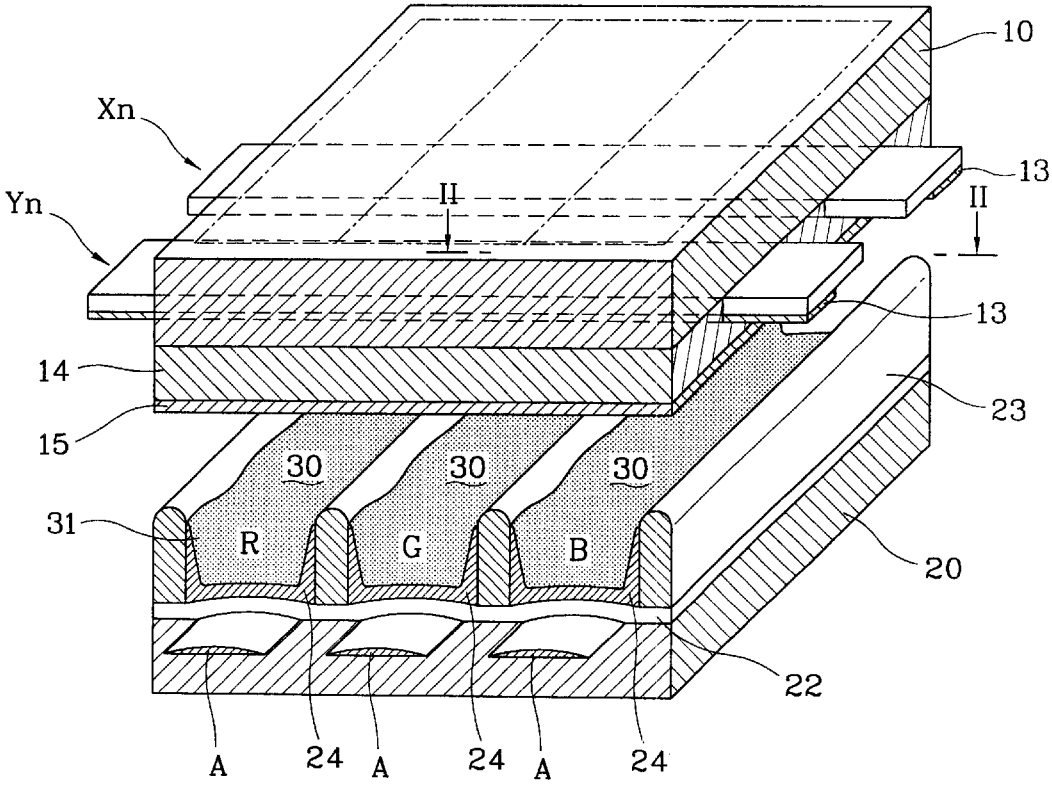
FIG. 1 CONVENTIONAL ART
FIG. 1 is a perspective view illustrating a conventional PDP.
Figure 2:
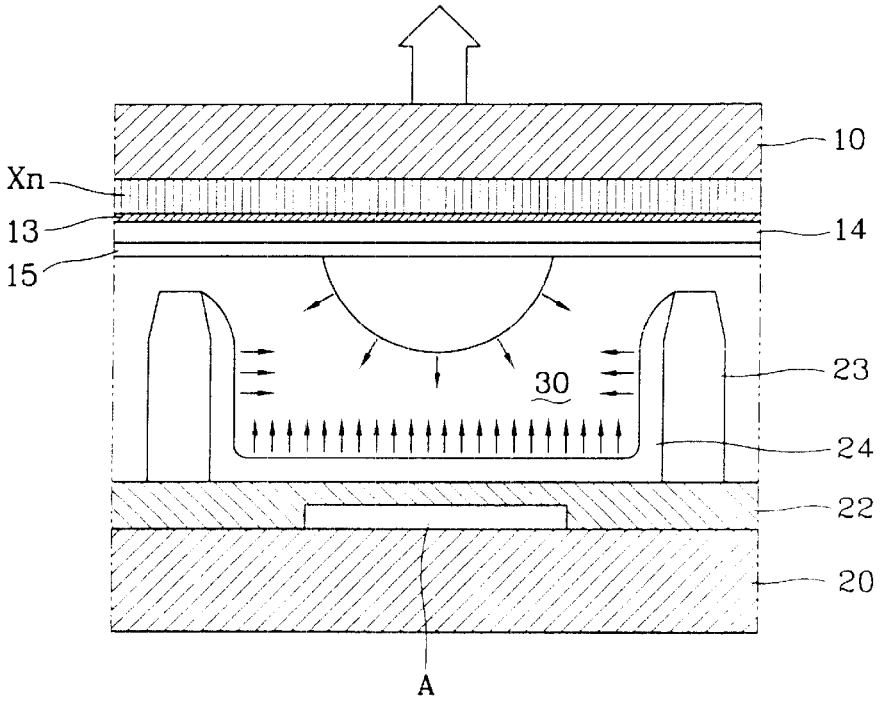
FIG. 2 is a cross-sectional view taken along line II—II of FIG. 1.

The length K1 of the area of the fluorescent in the discharge space of FIG. 2 is obtained based on the following Equation 2.

$$K1=h1x2x1 \qquad \text{Equation 2}$$

where K1 represents the entire length of the surface area of the fluorescent material in the discharge space, h1 represents a the length of the surface area of the fluorescent material coated on the barrier, and x1 represents the length of the surface area of the fluorescent material of the bottom of the discharge space between the barriers.

Since the height of the barrier is 150 μm, and the thickness of the fluorescent material is 20 m, the length h1 of the fluorescent material coated on the barriers is 130 μm which is obtained by abstracting the thickness of the fluorescent material. In addition, the spaced-apart distance between the barriers is 300 μm, and the length x1 of the surface of the fluorescent material on the bottom in the discharge space is 260 μm which is obtained by abstracting the thickness of 20 μm of the fluorescent material coated on the barrier from 300 μm.

When adapting the above-described values into Equation 2, $$K1=[(150\ \mu m-20\ \mu m)x2]+[300\ \mu m-(20\ \mu m x2)]=520\ \mu m$$

Namely, in the conventional art, the length of the entire surfaces of the fluorescent material in the discharge space is 520 μm.

However, the length of the surface area of the fluorescent material in the discharge space according to the present invention may be obtained based on the following Equation 3.

$$K2=h2x2+x1+x2 \quad \text{Equation 3}$$

where K2 represents the length of the surface area of the fluorescent material in the discharge space shown in FIG. 4 according to the present invention, h2 represents the length of the surface area of the fluorescent material coated on the second barrier, namely, on the walls of the ribs, x1 represents the length of the fluorescent material on the upper surface of the plane area formed between the rib portion of the second barrier and the groove of the first barrier among the lengths of the bottom areas in the discharge space, and x2 represents the length of the surface area of the fluorescent material formed on the upper surface of the semi-circular groove of the first barrier. In addition, since h2 is the same as h1 of Equation 2, h2 is 130 μm. x1 is 40 μm which is the length of the plane area. The length of the surface area of the fluorescent material of the upper surface of the semi-circular groove is πR(radius), and the radius of the groove is 130 μm. The fluorescent material having a thickness of 20 μm is formed on the surface of the groove. Therefore, the radius of the semi-circle to the surface of the fluorescent material is 110 μm.

K2 is obtained by adapting the above-described values to Equation 3 as follows.

$$K2=[(150\ \mu m-20\ \mu m)x2)]+40\ \mu m+[110\ \pi\mu m]=645.4\ \mu m$$

Namely, the length of the surface area of the fluorescent layer having the barrier structure according to the present invention shown in FIG. 4 is 645.4_m.

Therefore, when comparing K1 and K2, K2 is 1.25 times compared to K1.

Therefore, it is known that in the present invention the surface area of the fluorescent materials is increased, and the discharge efficiency is enhanced compared to the conventional art.

Figure 5:
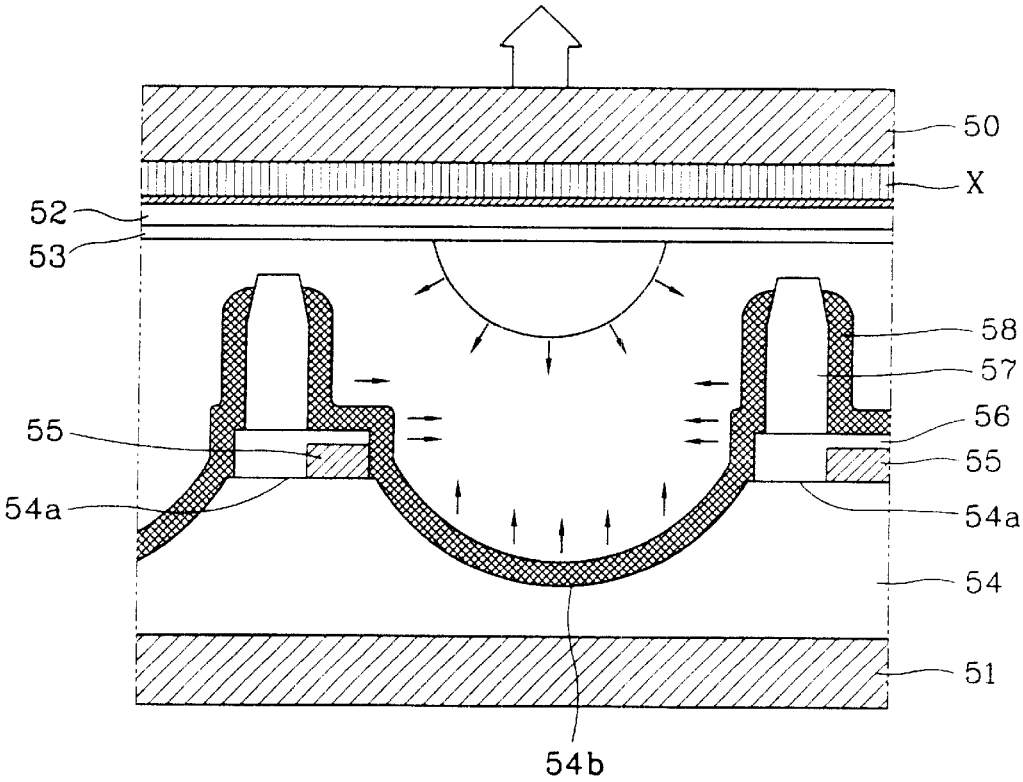
FIG. 5 is a cross-sectional view illustrating a PDP which adapts a barrier of FIG. 4 according to the present invention.

FIG. 5 illustrates the PDP structure which adapts the barrier structure of FIG. 4 according to the present invention. Namely, FIG. 5 illustrates an embodiment in that the barrier structure according to the present invention is adapted to the structure of the surface discharge PDP. The front substrate 50 and the rear substrate 51 are opposite to each other at a certain distance, and a plasma discharge occurs therebetween.

The sustain/scan electrode X and the scan electrode(not shown) are parallely arranged on one surface of the front substrate 50. A first dielectric layer 52 is formed on the sustain/scan electrode X, the scan electrode and the front substrate 50. A first dielectric layer protection film 53 is formed on the first dielectric layer 52.

A first barrier layer 54 is formed on the upper surface of the rear substrate 52 which is opposite to the front substrate 51. The first barrier layer 54 is formed of an insulation substrate formed of a plane area 54*a* and a groove 54*b*. An address electrode 55 is formed on the upper surface of the plane area 54*a* of the first barrier layer 54. A second dielectric layer 56 is formed on the upper surface of the first barrier layer 54 except for the address electrode 55 and the groove 54*b*. One end of the address electrode 55 is arranged at one end of the plane area 54*a* of the first barrier layer 64. A rib-shaped second barrier layer 57 having a certain height is formed on the upper surface of the second dielectric layer 56. In addition, the second barrier layer 57 is arranged at another end portion which is opposite to one end of the plane 54*a* of the first barrier layer 54. Therefore, the second barrier layer does not fully cover the upper surfaces of the address electrode 55 and the second dielectric layer 56.

A fluorescent layer 58 is formed on the upper surfaces of the second barrier layer 57, the second dielectric layer 56, and the groove 54*b* of the first barrier.

Figure 6:
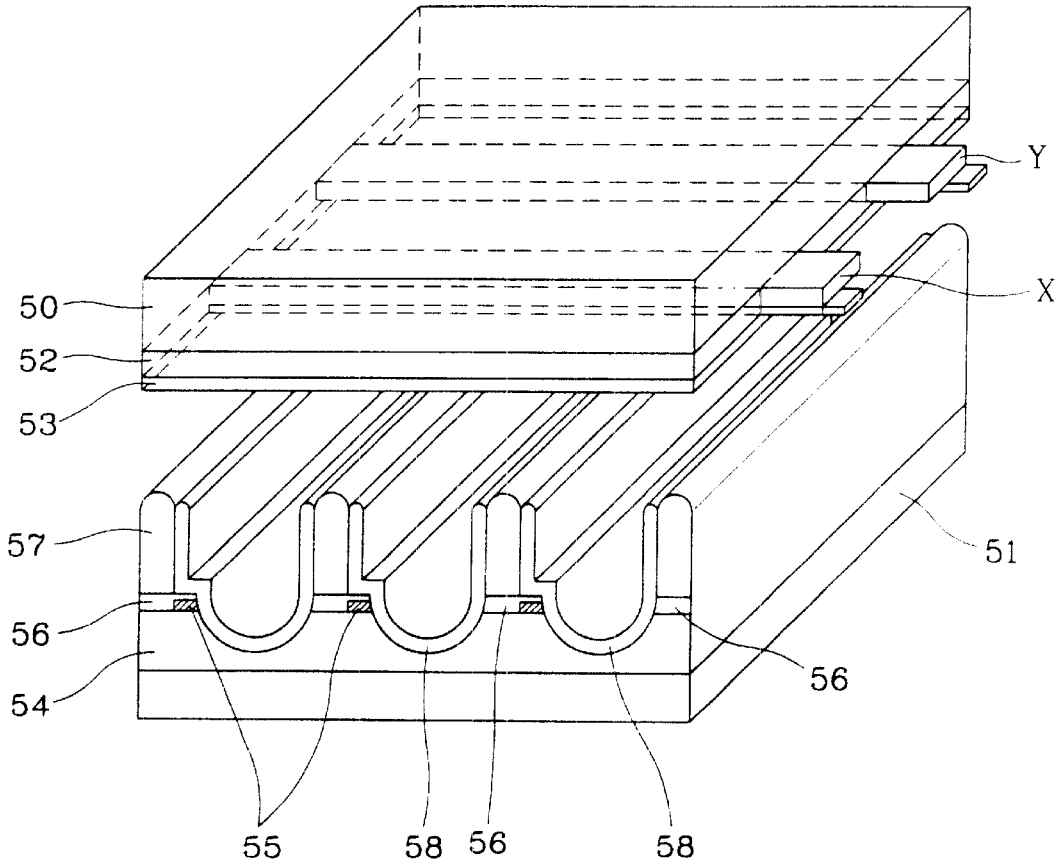
FIG. 6 is a perspective view illustrating the structure of FIG. 5.

FIG. 6 illustrates the surface discharge PDP of FIG. 5. The same reference numerals of FIGS. 5 and 6 illustrate the same elements. The description thereof will be omitted. In the embodiment of FIG. 6, a scan electrode Y is newly added.

Figure 7:
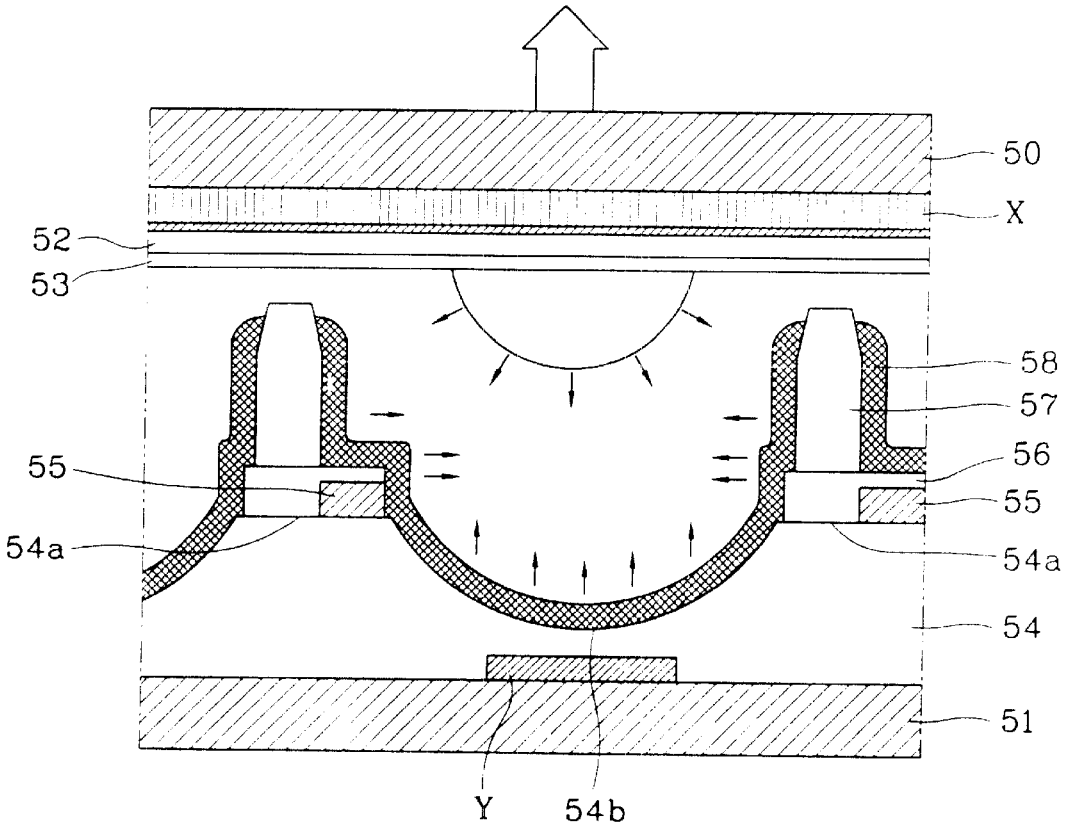
FIG. 7 is a view illustrating a structure of a PDP which adapts a barrier structure of FIG. 4 according to the present invention.

FIG. 7 is a cross-sectional view illustrating an opposite electrode type PDP which adapts the barrier structure according to the present invention. The same reference numerals of FIGS. 5 and 7 indicate the same elements. The description thereof will be omitted. In the opposite electrode type PDP of FIG. 7, the scan electrode Y' is formed on the upper surface of the rear substrate 51. The scan electrode Y' is formed in a direction perpendicular to the display/scan electrode X formed on the front substrate 50. In addition, the scan electrode Y' is formed between the rear substrate 51 and the first barrier 54.

As shown in FIG. 7, in the opposite electrode type PDP, a certain voltage is applied to the sustain/scan electrode X formed on the front substrate 50 and the scan electrode Y' formed on the rear substrate for thereby generating a plasma discharge. Generally, one electrode is formed on the front substrate, and another electrode is formed on the rear substrate, and then a voltage is applied to two electrodes, so that a plasma is generated. In this case, a good quality having a high an infrared ray generation efficiency is generated. However, in the case of the opposite electrode type PDP, since two electrodes are installed opposite to each other at a certain interval for generating plasma, the distance therebetween may be increased for thereby increasing the discharge voltage. In the case of the opposite electrode type PDP of FIG. 7, the address electrode is not formed at a lower portion of the discharge space but formed near the barrier. Therefore, the distance between two electrodes formed on the front substrate and the rear substrate is decreased compared to the conventional art. Therefore, since it is possible to decrease the discharge voltage compared to the conventional opposite electrode type PDP, the efficiency of the PDP is increased.

Figure 8:
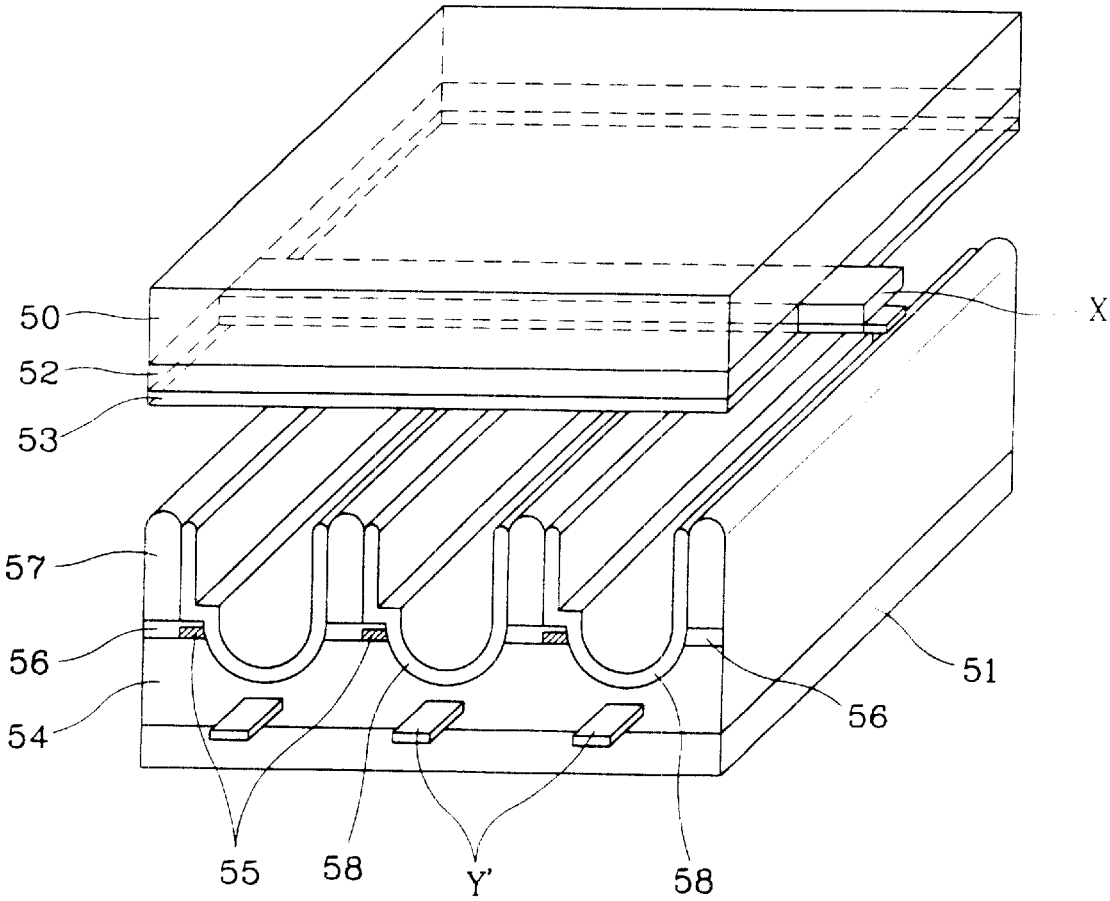
FIG. 8 is a perspective view illustrating the structure of FIG. 7.

FIG. 8 is a perspective view illustrating the structure of FIG. 7. The description of the same elements of FIGS. 7 and 8 will be omitted.

Next, the fabrication method of a PDP barrier structure according to the present invention will be explained with reference to FIGS. 9A through 9E.

Figure 9A:
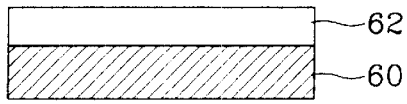
FIGS. 9A through 9E are cross-sectional views illustrating a fabrication method of a barrier for a PDP according to the present invention.

First, as shown in FIG. 9A, an insulation paster 62 having a certain thickness(for example, about 200 μm) is coated on the upper surface of the rear substrate 60 of the PDP by the screen printing method or a dry film is coated thereon. At this time, the glass paste 62 is formed of a material having a high reflection ratio with respect to visual light.

Next, the rear substrate 60 on which the glass paster 62 is formed is kept at a temperature of about 350° C. for about 15 minutes, and organic components in the paste 62 is burned, and a result material is processed at a temperature of about 550~650° C. for about 20 minutes.

Figure 9B:
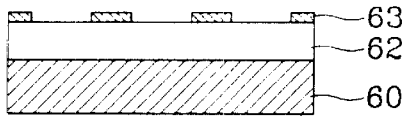

As shown in FIG. 9B, a photoresist is coated on the upper surface of the glass paste 62, and a photoresist pattern 63 is formed using a photo lithographic method, so that a part of the upper surface of th glass paste 62 is exposed.

Figure 9C:
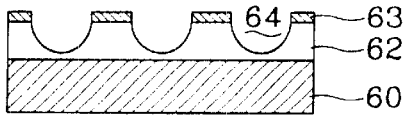

As shown in FIG. 9C, the glass paste 62 is wet-etched using Hcl as an etching solution and the photoresist film pattern 63 as a mask for thereby forming a semi-circular groove 64 having a radius of about 130 μm. As a method for etching the glass paste 62 when forming the groove 64, a dry isotropic etching method may be used.

Thereafter, the photoresist pattern 63 is removed, and the first barrier layer 70 is formed.

Figure 9D:
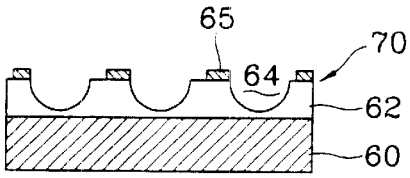

As shown in FIG. 9D, an address electrode 65 is formed on the upper surface of the glass paste 62 which is not etched due to the photoresist pattern 63 formed thereon. One end of the address electrode 65 is arranged at one end of the groove 64. The address electrode 65 is formed of a conductive film formed in a three-tire structure of chrome/copper/chrome or a conductive film of Ag.

Figure 9E:
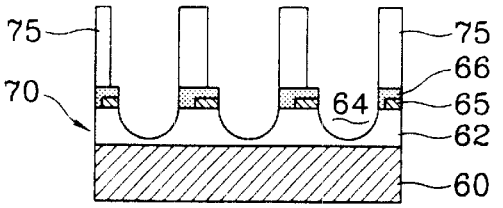

As show in FIG. 9E, a dielectric material 66 is coated on the upper surface of the glass paste 62 and the upper surface of the address electrode 65 except for the groove 64.

A rib-shaped second barrier layer 70 having a height of about 150 μm is formed on the upper surface of the dielectric material 66. As a method for forming the second barrier 75, a known screen printing method, a sand blast method, an additive method, an etching method, etc may be used.

As described above, the PDP barrier structure according to the present invention includes a first barrier layer formed of a groove and plane area, and a second barrier later formed on the plane area of the first barrier layer, so that it is possible to increase the coated area of the fluorescent material in the discharge space. As a result, the PDP which adapts the barrier structure according to the present invention is capable of increasing a discharge efficiency.

In addition, in the present invention, since it is possible to increase the discharge space without increasing the height of the rib-shaped second barrier layer, it is easy to fabricate the barrier having a uniform height.

In the PDP having a barrier structure according to the present invention, the address electrode is formed at an edge portion of the barrier without forming at the center portion of the discharge spaced, so that it is possible to decrease the distance between the sustain/scan electrode and the scan electrode formed on the front substrate and the rear substrate, respectively, for thereby decreasing the discharge voltage and enhancing the PDP efficiency.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A barrier structure for a PDP (Plasma Display Panel), comprising a first barrier layer formed on a substrate with a groove region which is etched to a certain depth in the first barrier layer and a plane area, and a second barrier layer is formed with a certain height on the plane area of the first barrier layer, and wherein a depth of the groove region and the height of the second barrier layer between a pair of second barrier layers form a discharge space, wherein the certain depth is less than the depth of the first barrier layer.

2. The structure of claim 1, wherein an address electrode is formed between the first barrier layer and the second barrier layer.

3. The structure of claim 2, wherein a dielectric layer is formed between the address electrode and the second barrier layer.

4. The structure of claim 3, wherein said address electrode is arranged at one side of the first barrier layer, and said second barrier layer is arranged at another side of the first barrier layer, and a part of the address electrode is not formed under the second barrier layer.

5. The structure of claim 4, wherein a part of each of the address electrode and the dielectric layer is not under the second barrier layer.

6. The structure of claim 1, wherein a combined width of the groove and the plane area between said pair of second barrier layers form the discharge space.

7. The structure of claim 6, wherein an address electrode is on the plane area not adjacent to the grove of the first barrier layer, wherein the second barrier layer is over a prescribed portion of the plane area.

8. A barrier fabrication method for a Plasma Display Panel (PDP), comprising:

forming the first barrier layer comprising, forming a first barrier material layer on a substrate by:

forming a paste layer or a dry film on the substrate; and heat-treating the paste layer or the dry film; and etching the first barrier material layer to form a groove therein; and forming a second barrier layer on an upper planar portion of the first barrier layer.

9. The method of claim 8, wherein in said etching step, a photoresist film pattern formed by patterning a photoresist film by a photo etching method is used as a mask.

10. The method of claim 8, wherein said second barrier layer is formed on the first barrier layer by a screen printing method, an etching method or an additive method.

11. The method of claim 8, further comprising forming an address electrode on the first barrier layer after said forming the first barrier layer.

12. The method of claim 11, further comprising forming a dielectric layer on the upper surface of the address electrode after said forming the address electrode.

13. A barrier structure for a Plasma Display Panel (PDP) comprising:

a substrate;

a dielectric first barrier layer formed on the substrate, the first barrier layer having a groove formed in an upper portion thereof; and a dielectric second barrier layer formed on the first barrier layer, at each side of the groove;

an address electrode formed between the first barrier layer and the second barrier layer, wherein the address electrode is not continuous between the first barrier layer and the second barrier layer;

whereby a total height of a discharge space of the PDP is defined by a depth of the groove in the first barrier layer plus a height of the second barrier layer.

14. The barrier structure for a PDP according to claim 13, wherein the depth of the groove in the first barrier layer is approximately 130 μm and the height of the second barrier layer is approximately 150 μm.

15. The barrier structure for a PDP according to claim 13, wherein the address electrode is not coplanar with the groove.

16. The barrier structure for a PDP according to claim 15, wherein one edge of the address electrode is adjacent to the groove in the first barrier layer and the address electrode is covered by the second barrier layer except at said adjacent edge.

17. The barrier structure for a PDP according to claim 13, wherein a lower portion of the second layer is wider than an upper portion thereof.

18. The barrier structure for a PDP according to claim 13, wherein a fluorescent layer is formed on sides of the second barrier layer and the first barrier layer including the groove therein.

19. The structure of claim 13, wherein the groove has a prescribed depth in the first barrier layer less than the total depth of the first barrier layer.

20. The structure of claim 13, wherein the groove is semicircular shaped.

21. The structure of claim 13, wherein the first barrier layer is non-conductive and directly adjacent to the second barrier layer.

22. The structure of claim 13, wherein the deepest portion of the groove is not centered between the second barrier layer at both sides of the groove.

23. The structure of claim 13, wherein the address electrode is not formed under at least half of the width of the second barrier layer.

24. The structure of claim 1, wherein said address electrode is arranged at one side of the first barrier layer, and said second barrier layer is arranged at another side of the first barrier layer, and a part of the address electrode is not formed under the second barrier layer.

25. The structure of claim 1, wherein a part of each of the address electrode and the dielectric layer is not under the second barrier layer.

26. The structure of claim 1, wherein the groove is semicircular shaped, and the second barrier layer is rib-shaped.

27. A barrier structure for a Plasma Display Panel (PDP), comprising a first barrier layer formed on a substrate and having a certain height, and a second barrier layer formed on the first barrier layer, wherein an address electrode is formed between the first barrier layer and the second barrier layer and wherein the first barrier layer has a recess and a planar portion in an upper portion thereof, wherein the second barrier layer is formed on the planar portion, and wherein a discharge space height is formed by a depth of the recess and a height of the second barrier layer between a pair of second barrier layers.

28. The structure of claim 26, wherein one edge of the address electrode is adjacent to the groove in the first barrier layer, wherein a dielectric layer is formed between the address electrode and the second barrier layer, wherein the second barrier layer is over a prescribed portion of the planar portion, and wherein the address electrode is not covered by the second barrier layer at least at said adjacent edge.

* * * * *